US009637804B2

(12) United States Patent
Noguchi et al.

(10) Patent No.: US 9,637,804 B2
(45) Date of Patent: May 2, 2017

(54) HEAT TREATING OIL COMPOSITION

(71) Applicant: IDEMITSU KOSAN CO., LTD., Chiyoda-ku (JP)

(72) Inventors: Kenro Noguchi, Ichihara (JP); Masayuki Kato, Ichihara (JP); Katsumi Ichitani, Ichihara (JP); Masahiro Kobessho, Chiyoda-ku (JP); Masahiro Yamada, Toyota (JP); Norihiro Takasaki, Toyota (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 100 days.

(21) Appl. No.: 14/380,225

(22) PCT Filed: Mar. 14, 2013

(86) PCT No.: PCT/JP2013/057142

§ 371 (c)(1),
(2) Date: Aug. 21, 2014

(87) PCT Pub. No.: WO2013/137376

PCT Pub. Date: Sep. 19, 2013

(65) Prior Publication Data

US 2015/0013843 A1 Jan. 15, 2015

(30) Foreign Application Priority Data

Mar. 16, 2012 (JP) ..... 2012-060842

(51) Int. Cl.

| | |
|---|---|
| ***C21D 1/58*** | (2006.01) |
| ***C10M 169/04*** | (2006.01) |
| ***C10M 111/02*** | (2006.01) |
| ***C10M 107/04*** | (2006.01) |
| *C21D 9/32* | (2006.01) |

(52) U.S. Cl.

CPC ..... *C21D 1/58* (2013.01); *C10M 107/04* (2013.01); *C10M 111/02* (2013.01); *C10M 169/041* (2013.01); *C10M 2203/1025* (2013.01); *C10M 2205/022* (2013.01); *C10M 2205/028* (2013.01); *C10M 2205/0225* (2013.01); *C10M 2205/0285* (2013.01); *C10N 2220/022* (2013.01); *C10N 2240/40* (2013.01); *C21D 9/32* (2013.01)

(58) Field of Classification Search

CPC .... C21D 1/58; C10M 111/00; C10M 169/041
USPC ..... 148/29
See application file for complete search history.

(56) References Cited

U.S. PATENT DOCUMENTS

| | | | | |
|---|---|---|---|---|
| 2003/0201205 | A1* | 10/2003 | Ichitani | C21D 1/58 208/14 |
| 2007/0191241 | A1 | 8/2007 | Ichitani et al. | |
| 2009/0056834 | A1 | 3/2009 | Kobessho et al. | |
| 2010/0186853 | A1 | 7/2010 | Ichitani | |

FOREIGN PATENT DOCUMENTS

| | | | |
|---|---|---|---|
| CN | 1462314 | A | 12/2003 |
| CN | 101213313 | A | 7/2008 |
| CN | 101765640 | A | 6/2010 |
| EP | 1 897 960 | A1 | 3/2008 |
| EP | 2 174 986 | A1 | 4/2010 |
| JP | 2001 152243 | | 6/2001 |
| JP | 2002 038214 | | 2/2002 |
| JP | 2002 327191 | | 11/2002 |
| JP | 2007 009238 | | 1/2007 |
| JP | 3986864 | | 10/2007 |
| JP | 4659264 | | 3/2011 |
| JP | 4691405 | | 6/2011 |
| WO | WO 2005/087955 | A1 | 9/2005 |
| WO | WO 2007/000976 | A1 | 1/2007 |

OTHER PUBLICATIONS

Extended European Search Report issued Oct. 21, 2015 in Patent Application No. 13761012.7.
Combined Office Action and Search Report issued Sep. 1, 2015 in Chinese Patent Application No. 201380014066.X (with partial English language translation and English translation of categories of cited documents).
Office Action issued Jun. 9, 2015 in Japanese Patent Application No. 2012-060842 (with English language translation).
International Search Report issued Apr. 23, 2013 in PCT/JP13/057142 filed Mar. 14, 2013.

* cited by examiner

*Primary Examiner* — Weiping Zhu
(74) *Attorney, Agent, or Firm* — Oblon, McClelland, Maier & Neustadt, L.L.P.

(57) ABSTRACT

A heat-treatment oil composition contains (A) a first base oil with a kinematic viscosity at 40 degrees C. in a range of 5 $mm^2/s$ to 60 $mm^2/s$ in an amount of 50 mass % to 95 mass % of a total amount of the composition, (B) a second base oil with a kinematic viscosity at 40 degrees C. of 300 $mm^2/s$ or more in an amount of 5 mass % to 50 mass %, and (C) an alpha-olefin copolymer. The heat-treatment oil composition according to the invention can reduce distortion unevenness and hardness unevenness accompanying mass-quenching.

6 Claims, No Drawings

HEAT TREATING OIL COMPOSITION

TECHNICAL FIELD

The present invention relates to a heat-treatment oil composition used for, for instance, quenching a metal material.

BACKGROUND ART

In order to improve the properties of a metal material such as steel, the metal material is often subjected to a heat treatment such as quenching, tempering, annealing and normalizing. In the above heat treatments, quenching is a treatment according to which a heated metal material is immersed in a coolant to be transformed into a predetermined hardened structure. As a result, the quenched object becomes considerably hard. For instance, when heated steel in an austenitic phase is immersed in a coolant and cooled at an upper critical cooling rate or higher, the steel can be transformed into a hardened structure such as martensite.

As a coolant, an oil- or water-soluble quenchant is typically used. Now, quenching of steel is explained. When heated steel is put in a heat-treatment oil (i.e., coolant), the steel is not cooled at a constant cooling rate but usually cooled through the following three stages (1) to (3). Specifically, the steel is cooled through (1) a first stage where the steel is surrounded by the steam of the heat-treatment oil (i.e., a vapor blanket stage), (2) a second stage where a vapor blanket is ruptured and boiling occurs (i.e., a boiling stage) and (3) a third stage where the temperature of the steel falls below the boiling point of the heat-treatment oil and the heat of the steel is absorbed by convection (i.e., a convection stage). The cooling rate becomes the highest at the second stage (boiling stage) of the above three stages.

Generally, when the heat-treatment oil is used, the cooling rate is rapidly increased especially at the boiling stage. Therefore, when a surface of the object to be treated experiences a transitional phase where the vapor blanket stage and the boiling stage are mixed, the surface of the object to be treated is subjected to an extremely large temperature difference. Such a temperature difference results in a difference in thermal contraction and time lag of transformation and thus in generation of thermal stress and transformation stress, which increases quenching distortion.

Accordingly, for a heat treatment, especially quenching, of a metal, it is important to select a heat-treatment oil suitable for heat-treatment conditions. When an unsuitable oil is selected, the metal is likely to be insufficiently hardened and have a severe distortion.

Heat-treatment oils are categorized into Classes 1 to 3 according to JIS K 2242 and oils of Class 1, No. 1 and No. 2 and Class 2, No. 1 and No. 2 are used for quenching. Regarding the above oils, JIS K 2242 defines, as an index of cooling performance, a cooling time (sec) required for reduction from 800 degrees C. to 400 degrees C. according to the JIS cooling curve. Specifically, the cooling time of the oils of Class 1, No. 2 is defined as 4.0 seconds or less, Class 2, No. 1 is 5.0 second or less, and Class 2, No. 2 is defined as 6.0 seconds or less. When the cooling time is shorter, it means that the cooling performance is higher and thus the hardness of the heat-treated object is further enhanced. Generally, hardness and quenching distortion are in a trade-off relationship, which means that a higher hardness results in a larger quenching distortion.

Industrially, an H-value is also frequently used as an index of the cooling performance of a quenching oil. The H-value can be calculated from a cooling time required for reduction from 800 degrees C. to 300 degrees C. according to the JIS cooling curve. In order to achieve desired hardness and quenching distortion, a user selects a quenching oil based on the above indexes. For instance, for quenching an automobile gear or the like, for which distortion may cause a problem, an oil of JIS Class 2, No. 1 is frequently used. This is because an oil of JIS Class 1 increases distortion and excessively enhances the hardnesses of some components. In contrast, an oil of Class 2, No. 2 reduces distortion but cannot provide a sufficient hardness.

Components of automobile transmission, reducer and the like are usually mass-produced and thus subjected to so-called mass-quenching, according to which a large number of objects to be treated are piled up on one tray and subjected to quenching at the same time. The thus-hardened components vary in hardness and distortion depending on where the components are arranged in the pile. For instance, while the components arranged near the bottom of the pile have a high hardness, the components arranged near the top of the pile have a low hardness.

In order to reduce such an unevenness accompanying the mass-quenching, it has been considered that specific equipment such as a vibrator and an injector is added according to Patent Literature 1. However, addition of such equipment to a typical device is costly and it is difficult to reconstruct the device to be added with some types of equipment. Accordingly, in order to avoid such equipment investment, it has been desired to develop a technique for reducing the unevenness only based on the properties of a quenching oil. For instance, it has also been considered that an object to be treated is cooled below the characteristic temperature of a quenching oil using gas prior to oil-quenching in order to reduce the influence of the characteristic time (sec) of the quenching oil (Patent Literature 2) and that an object to be treated is temporarily taken out of a quenching oil to be soaked when heated to a martensite-transformation-start temperature in order to eliminate a temperature difference in the object to be treated resulting from uneven cooling (Patent Literature 3). However, both methods are more costly and more time-consuming than a simple quenching. Further, these methods, which are intended to reduce distortion, cannot reduce distortion unevenness.

Patent Literature 4 discloses a heat-treatment oil composition that is less likely to unevenly cool a metal material to be quenched and reliably provides hardness to the quenched material while reducing quenching distortion, the heat-treatment oil composition containing a mixed base oil of a low-viscosity base oil with a kinematic viscosity at 40 degrees C. of 5 to 60 $mm^2/s$ in an amount of 50 to 95 weight % and a high-viscosity base oil with a kinematic viscosity at 40 degrees C. of 300 $mm^2/s$ or more in an amount of 50 to 5 weight %. However, Patent Literature 5 teaches that the composition prepared based on the above composition range provides excessive hardness when used for an automobile gear or the like.

Patent Literature 5 discloses a quenching oil composition capable of reducing unevenness of cooling performance during mass-quenching. Especially, Patent Literature 5 discloses a quenching oil composition that exhibits a cooling performance similar to that of an oil of JIS Class 2, No. 1 (i.e., an oil used for quenching components of automobile transmission or reducer where distortion causes a problem) and is capable of reducing unevenness of the cooling performance during mass-quenching. Specifically, the disclosed composition is a heat-treatment oil composition containing a mixed base oil of a low-boiling-point base oil with a 5%-distillation temperature in a range of 300 to 400 degrees C. in an amount of 5 mass % to 50 mass % and a high-boiling-point base oil with a 5%-distillation temperature of 500 degrees C. or higher in an amount more than 50 mass % but not more than 95%. However, further examination has revealed that the composition according to the invention of Patent Literature 5 cannot always improve distortion unevenness depending on the shape of a gear.

CITATION LIST

Patent Literature(s)

Patent Literature 1: Japanese Patent No. 3986864
Patent Literature 2: JP-A-2002-38214
Patent Literature 3: JP-A-2001-152243
Patent Literature 4: Japanese Patent No. 4659264
Patent Literature 5: Japanese Patent No. 4691405

SUMMARY OF THE INVENTION

Problems to be Solved by the Invention

An object of the invention made in view of the above circumstances is to provide a heat-treatment oil composition capable of reducing unevenness of cooling performance during mass-quenching.

Means for Solving the Problems

In order to solve the above problems, according to an aspect of the invention, the following heat-treatment oil compositions are provided:

(1) A heat-treatment oil composition contains: (A) a first base oil with a kinematic viscosity at 40 degrees C. in a range of 5 $mm^2/s$ to 60 $mm^2/s$ in an amount of 50 mass % to 95 mass % of a total amount of the composition; (B) a second base oil with a kinematic viscosity at 40 degrees C. of 300 $mm^2/s$ or more in an amount of 5 mass % to 50 mass %; and (C) an alpha-olefin copolymer;

(2) In the heat-treatment oil composition, the component (C) contains an ethylene-alpha-olefin copolymer;

(3) In the heat-treatment oil composition, a blending amount of the component (C) is in a range of 0.1 mass % to 30 mass % of the total amount of the composition;

(4) In the heat-treatment oil composition, a characteristic time (sec) (vapor blanket duration) of the heat-treatment oil composition according to a cooling performance test of JIS K 2242 is one second or less and a maximum cooling rate at a boiling stage is 400 degrees C./s or less; and (5) In the heat-treatment oil composition, a 300-degrees-C-reached time (sec) according to a cooling performance test of JIS K 2242 is in a range of 8 seconds to 12 seconds.

Any of the above heat-treatment oils according to the above aspects can significantly reduce the unevenness of cooling performance (e.g., distortion unevenness and hardness unevenness) during mass-quenching while maintaining a cooling performance similar to that of an oil of JIS Class 2, No. 1 that is often used as a quenching oil for, for instance, components of automobile transmission or reducer. Further, the above heat-treatment oils can be used for materials or components in various shapes.

DESCRIPTION OF EMBODIMENT(S)

A heat-treatment oil composition according to an exemplary embodiment of the invention (hereinafter, also referred to as "the present composition") contains a mixed base oil of (A) a predetermined low-viscosity base oil and (B) a predetermined high-viscosity base oil, and is further blended with (C) an alpha-olefin copolymer. The exemplary embodiment of the invention will be described below in detail.

The low-viscosity base oil as the component (A) has a kinematic viscosity at 40 degrees C. of 5 $mm^2/s$ to 60 $mm^2/s$. An oil with a kinematic viscosity at 40 degrees C. less than 5 $mm^2/s$ has a high volatility and thus is not suitable as the base oil of the present composition. On the other hand, when an oil with a kinematic viscosity at 40 degrees C. more than 60 $mm^2/s$ is used, a quenched object cannot be provided with a sufficient hardness. In view of the above, a preferable kinematic viscosity at 40 degrees C. is set in a range of 5 $mm^2/s$ to 35 $mm^2/s$.

The high-viscosity base oil as the component (B) has a kinematic viscosity at 40 degrees C. of 300 $mm^2/s$ or more. When the kinematic viscosity at 40 degrees C. is less than 300 $mm^2/s$, the cooling performance is excessively enhanced at the boiling stage and thus cannot exhibit an effect in reducing quenching distortion. On the other hand, when the kinematic viscosity at 40 degrees C. is excessively high, the cooling performance becomes unfavorable. In view of the above, a preferable kinematic viscosity is set in a range of 400 $mm^2/s$ to 1000 $mm^2/s$.

According to the exemplary embodiment, a mixed base oil of the low-viscosity base oil (i.e., the component (A)) in an amount of 50 mass % to 95 mass % and the high-viscosity base oil (i.e., the component (B)) in an amount of 5 mass % to 50 mass % is used as the base oil so that the composition can efficiently exhibit the above effects.

As a low-viscosity base oil and a high-viscosity base oil according to the exemplary embodiment, mineral oil and synthetic oil are usable. Examples of the mineral oil are fractions of paraffin mineral oil, naphthene mineral oil and aromatic mineral oil, which may be prepared by any purification methods such as solvent purification, hydrorefining and hydrocracking. Examples of the synthetic oil are alkylbenzenes, alkylnaphthalenes, alpha-olefin oligomers and hindered ester oil.

As each of the low-viscosity base oil and the high-viscosity base oil for the present composition, any one of the above mineral oils or a combination of two or more thereof may be used or, alternatively, any one of the above synthetic oils or a combination of two or more thereof may be used. Further alternatively, a combination of one or more of the above mineral oils and one or more of the above synthetic oils may be used. The present composition further contains another base oil in addition to the above mixed base oil as long as the effects of the invention are not hampered.

According to the exemplary embodiment, (C) the alpha-olefin copolymer is further blended to the above mixed base oil. By blending the component (C), the vapor blanket stage in the quenching process can be controlled to significantly reduce distortion unevenness and hardness unevenness accompanying mass-quenching. Even though being known as a vapor-blanket-rupturing agent, substances such as polyolefins (i.e., homopolymers of polybutene and the like) and polymethacrylate, which are not alpha-olefin copolymers, are not suitable as the component (C) because the composition cannot sufficiently exhibit the above effects.

The component (C) is preferably an ethylene-alpha-olefin copolymer. The mass average molecular weight of the component (C) is preferably in a range of 1000 to 5000 in terms of the effects of the invention. The blending amount of the component (C) in the present composition is preferably in a range of 0.1 mass % to 30 mass %, more preferably in a range of 1 mass % to 20 mass %, and further preferably in a range of 3 mass % to 10 mass %. As long as the blending amount is in the above range, the component (C) suitably exhibits a vapor-blanket-rupturing effect to reduce distortion unevenness and/or hardness unevenness among the materials subjected to mass-quenching. Further, the kinematic viscosity of the present composition is also suitably adjusted, so that the present composition can favorably function as a heat-treatment oil composition.

Preferably, the characteristic time (sec) (vapor blanket duration) of the present composition according to a cooling performance test (JIS K 2242) is one second or less and the maximum cooling rate of the present composition at the boiling stage is 400 degrees C./s or less.

Specifically, when the vapor blanket duration is shortened and the maximum cooling rate is lowered, the vapor blanket can be ruptured with less unevenness and thus distortion unevenness and/or hardness unevenness can be reduced irrespective of the shape of materials or components to be quenched.

Further, the 300-degrees-C-reached time (sec) of the present composition according to the cooling performance test (JIS K 2242) is preferably in a range of 8 seconds to 12 seconds. The "300-degrees-C-reached time" stands for a cooling time (sec) required for reduction from 800 degrees C. to 300 degrees C. according to the cooling performance test (JIS K 2242). When the 300-degrees-C-reached time is less than eight seconds, hardness provided by quenching may be excessively high. On the other hand, when the 300-degrees-C-reached time exceeds 12 seconds, hardness provided by quenching may be insufficient.

The present composition preferably has a kinematic viscosity at 100 degrees C. in a range of 5 $mm^2/s$ to 50 $mm^2/s$. As long as the kinematic viscosity at 100 degrees C. is 5 $mm^2/s$ or more, the hardness is prevented from becoming excessively high and inflammability can be favorably lowered. On the other hand, as long as the kinematic viscosity at 100 degrees C. is 50 $mm^2/s$ or less, a sufficient hardness can be provided and detergency is favorably less deteriorative. In view of the above, the kinematic viscosity at 100 degrees C. of the present composition is father preferably in a range of 8 $mm^2/s$ to 35 $mm^2/s$.

The present composition may be added with additives typically used for a heat-treatment oil such as an antioxidant, a detergent dispersant and a brightness improver as needed as long as an object of the invention can be achieved.

As the antioxidant, known phenolic antioxidant and amine antioxidant are usable. Examples of the phenolic antioxidant include monophenolic antioxidants such as 2,6-di-tert-butyl-4-methylphenol, 2,6-di-tert-butyl-4-ethylphenol and 2,4,6-tri-tert-butylphenol, and polyphenolic antioxidants such as 4,4-methylenebis(2,6-di-tert-butylphenol) and 4,4'-isopropylidenebis(2,6-di-tert-butylphenol). Examples of the amine antioxidant include diphenylamine, monooctyl diphenylamine and monononyl diphenylamine. The blending amount of the antioxidant is approximately in a range of 0.01 mass % to 5 mass % of the total amount of the composition in terms of an antioxidant effect and economic balance.

Examples of the detergent dispersant include an ashless dispersant and a metal detergent. Examples of the ashless dispersant include alkenyl succinimides, boron-containing alkenyl succinimides, benzylamines, boron-containing benzylamines, succinates, and amides of mono- or di-carboxylic acid typified by aliphatic or succinic acid. Examples of the metal detergent include neutral metal sulfonates, neutral metal phenates, neutral metal salicylates, neutral metal phosphonates, basic sulfonates, basic phenates, basic salicylates, overbased sulfonates, overbased salicylates and overbased phosphonates. The above substances as the detergent dispersant are effective in dispersing sludge generated when the heat-treatment oil composition is repeatedly used, and the metal detergent also functions as a neutralizer for deteriorated acid. The blending amount of the detergent dispersant is approximately in a range of 0.01 mass % to 5 mass % of the total amount of the composition in terms of efficiency and economic balance.

Examples of the brightness improver include known fat, oil and oil fatty acid, alkenyl succinimide, and substituted hydroxy aromatic carboxylic acid ester derivative.

EXAMPLES

Next, the invention will be described in further detail with reference to Examples, which by no means limit the invention. Specifically, two types of materials were subjected to a heat treatment (mass-quenching) using a sample oil, and distortion unevenness and hardness unevenness of each material was evaluated.

Example 1 and Comparatives 1 to 6

Sample Oil

Table 1 shows components and properties of the sample oil used for each of Example and Comparatives.

TABLE 1

| | | Ex. 1 | Comp. 1 | Comp. 2 | Comp. 3 | Comp. 4 | Comp. 5 | Comp. 6 |
|---|---|---|---|---|---|---|---|---|
| Base Oil[1)] | A: 40° C. Kinematic Viscosity 15 $mm^2/s$ | — | — | — | 94 | | — | 25 |
| (mass %) | B: 40° C. Kinematic Viscosity 20 $mm^2/s$ | — | 25 | — | — | 100 | — | — |
| | C: 40° C. Kinematic Viscosity 45 $mm^2/s$ | 80 | — | — | — | — | — | — |
| | D: 40° C. Kinematic Viscosity 90 $mm^2/s$ | — | — | 49 | — | — | — | — |
| | E: 40° C. Kinematic Viscosity 420 $mm^2/s$ | — | 68 | 40 | — | — | 90 | 72 |
| | F: 40° C. Kinematic Viscosity 490 $mm^2/s$ | 10 | — | 10 | — | — | 10 | — |
| Additives | α-olefin copolymer[2)] | 8 | 6 | — | — | — | — | — |
| (mass %) | Detergent Dispersant etc. | 2 | 1 | 1 | 6 | — | — | 3 |
| Properties | Characteristic Time (sec) | 0.84 | 1.57 | 1.57 | 2.03 | 4.46 | 0.78 | 2.13 |
| | Maximum Cooling Rate (° C./s) | 311 | 287 | 486 | 787 | 338 | 446 | 381 |
| | 300° C.-reached Time (sec) | 11.2 | 10.8 | 11.3 | 5.4 | 8.8 | 15.9 | 9.3 |
| Test | Temperature at Quenching (° C.) | 130 | 130 | 130 | 80 | 80 | 160 | 130 |
| Conditions | Kinematic Viscosity at Quenching ($mm^2/s$) | 8.448 | 13.210 | 8.949 | 5.617 | 6.350 | 8.084 | 7.525 |

[1)]The base oil F is categorized into Group I but the other base oils are categorized into Group II.

[2)]LUCANT (Mw 3500) manufactured by Mitsui Chemicals, Inc was used.

Evaluation Method

Materials to be evaluated (shown below) were subjected to a heat treatment (mass-quenching) under predetermined conditions, and distortion unevenness and hardness unevenness were evaluated. An evaluation method was the same as one described in connection with Example of JP-A-2007-9238.

(1) Materials to be Evaluated and Heat-treatment Conditions

1) Counter drive gear (module 2.45)

See Example 1-1 and Comparatives 1-1 to 6-1 in Table 2 for results of the use of the sample oils of Example 1 and Comparatives 1 to 6, respectively.

Material: SCr420

Heat-treatment conditions:

carburizing process: 950 degrees C.×48 minutes, Cp=1.1 mass % dispersing process: 930 degrees C.×36 minutes, Cp=0.8 mass % soaking process: 850 degrees C.×20 minutes, Cp=0.8 mass %

Oil-quenching conditions:

oil temperatures shown below, cooling time 4 minutes, stirring 20 cm/sec

Example 1 and Comparatives 1, 2 and 6: oil temperature 130 degrees C.

Comparatives 3 and 4: oil temperature 80 degrees C.

Comparative 5: oil temperature 160 degrees C.

Incidentally, the oil temperatures were regulated so that the sample oils exhibit a practical kinematic viscosity.

Tempering conditions: 130 degrees C.×90 minutes

2) Differential drive pinion gear (module 2.36)

soaking process: 850 degrees C.×60 minutes, Cp=0.8 mass %

Oil-quenching conditions and tempering conditions were the same as the conditions of 1).

(2) Evaluation Items

Difference between maximum and minimum values of torsion angle error (μm)

Torsion angle error 3σ (μm)

Tooth-flank hardness (internal hardness, HV) (according to JIS Z 2244)

Difference between maximum and minimum values of tooth-flank hardness

Effective carburized depth (mm)(according to JIS G 0557)

Effective carburized depth 3σ(mm)

A reduction in a torsion angle error leads to an improvement in the accuracy of a component to be manufactured (a gear according to Examples). For instance, when the accuracy of a gear is improved, vibration and noise accompanying the engagement of the gear can be reduced and thus a quiet transmission can be manufactured. For a bearing, quiet operation and elongated lifetime can be achieved. When quenching accuracy is improved, the machining tolerance of a non-quenched component can be increased and thus the component can be more easily machined. When the unevenness of tooth-flank hardness and unevenness of effective carburized depth are reduced, it is not necessary to excessively increase the hardness so that the minimum value can fall within a desired range and thus a component can be efficiently and economically manufactured. A reduction in hardness unevenness results in an improvement in component lifetime (e.g., fatigue).

TABLE 2

| | | Ex. 1-1 | Comp. 1-1 | Comp. 2-1 | Comp. 3-1 | Comp. 4-1 | Comp. 5-1 | Comp. 6-1 |
|---|---|---|---|---|---|---|---|---|
| Evaluation Items | Difference between Max and Min Torsion Angle Errors (μm) | 11.7 | 20.4 | 17.5 | 36.5 | 15.2 | 20.7 | 29.4 |
| | Torsion Angle Error 3 σ (μm) | 14.4 | 28.0 | 23.0 | 42.9 | 22.1 | 26.1 | 35.1 |
| | Tooth-flank Hardness (HV) | 323 | 315 | 320 | 385 | 364 | 312 | 330 |
| | Difference between Max and Min Tooth-flank Hardnesses (HV) | 15 | 27 | 13 | 18 | 29 | 14 | 20 |
| | Effective Carburized Depth (mm) | 0.72 | 0.60 | 0.70 | 0.83 | 0.80 | 0.65 | 0.71 |
| | Effective Carburized Depth 3 σ (mm) | 0.15 | 0.15 | 0.10 | 0.05 | 0.08 | 0.15 | 0.07 |

TABLE 3

| | | Ex. 1-2 | Comp. 1-2 | Comp. 2-2 | Comp. 3-2 | Comp. 4-2 | Comp. 5-2 | Comp. 6-2 |
|---|---|---|---|---|---|---|---|---|
| Evaluation Items | Difference between Max and Min Torsion Angle Errors (μm) | 6.0 | 1.5 | 17.3 | 21.9 | 25.2 | 14.4 | 8.5 |
| | Torsion Angle Error 3 σ (μm) | 25.1 | 28.9 | 31.3 | 40.6 | 45.3 | 54.4 | 36.0 |
| | Tooth-flank Hardness (HV) | 318 | 308 | 332 | 426 | 394 | 331 | 352 |
| | Difference between Max and Min Tooth-flank Hardnesses (HV) | 4 | 3 | 14 | 38 | 25 | 43 | 24 |
| | Effective Carburized Depth (mm) | 1.04 | 0.90 | 1.05 | 1.43 | 1.34 | 1.06 | 1.10 |
| | Effective Carburized Depth 3 σ (mm) | 0.06 | 0.10 | 0.18 | 0.50 | 0.24 | 0.22 | 0.23 |

See Example 1-2 and Comparatives 1-2 to 6-2 in Table 3 for results of the use of the sample oils of Example 1 and Comparatives 1 to 6, respectively.

Material: SCM420

Heat-treatment conditions:

carburizing process: 950 degrees C.×150 minutes, Cp=1.1 mass % dispersing process: 930 degrees C.×60 minutes, Cp=0.8 mass %

Evaluation Results

As shown in Tables 2 and 3, when mass-quenching is performed using the sample oil satisfying the conditions according to the invention (Example 1), distortion unevenness and hardness unevenness are reduced (Examples 1-1 and 1-2). It is also found that the sample oil can be favorably used for materials in different shapes.

In contrast, it can be understood from Comparatives that the distortion unevenness and hardness unevenness accompanying mass-quenching cannot be reduced unless all the conditions (i.e., the viscosity ranges of the low-viscosity base oil and the high-viscosity base oil, the mixing ratio of the low-viscosity base oil and the high-viscosity base oil, and blending of the alpha-olefin copolymer) are satisfied.

It should be noted that the characteristic time (sec) is one second or less and the maximum cooling rate is 400 degrees C./s or less in each of Examples 1-1 and 1-2.

The invention claimed is:

1. A heat-treatment oil composition, comprising:

a mixed base oil comprising (A) a first base oil with a kinematic viscosity at 40° C. in a range of 5 $mm^2/s$ to 60 $mm^2/s$ in an amount of 50 mass % to 95 mass % of a total amount of the mixed base oil, and (B) a second base oil with a kinematic viscosity at 40° C. of 300 $mm^2/s$ or more in an amount of 5 mass % to 50 mass % of the total amount of the mixed base oil; and (C) an alpha-olefin copolymer having a mass average molecular weight in a range of 1000 to 5000 in an amount of 8 mass % or more of a total amount of the composition, wherein the composition has a characteristic time of one second or less and a maximum cooling rate at a boiling stage of 400° C./s or less according to a cooling performance test of JIS K 2242.

2. The heat-treatment oil composition according to claim 1, wherein the alpha-olefin copolymer comprises an ethylene-alpha-olefin copolymer.

3. The heat-treatment oil composition according to claim 1, wherein the alpha-olefin copolymer is in a range of 8 mass % to 30 mass % of the total amount of the composition.

4. The heat-treatment oil composition according to claim 1, wherein the composition has a maximum cooling rate of 311° C./s or less at a boiling stage.

5. The heat-treatment oil composition according to claim 1, wherein the composition has a 300° C.-reached time of from 8 seconds to 12 seconds according to a cooling performance test of JIS K 2242.

6. The heat-treatment oil composition according to claim 1, wherein the alpha-olefin copolymer is in a range of 8 mass % to 20 mass % of the total amount of the composition.

* * * * *